US009180992B2

(12) United States Patent
Kim

(10) Patent No.: US 9,180,992 B2
(45) Date of Patent: Nov. 10, 2015

(54) TABLET DISPENSER OF MEDICINE PACKING APPARATUS AND TABLET DISPENSING METHOD THEREOF

(75) Inventor: Ho Yeon Kim, Anyang-si (KR)

(73) Assignee: CRETEM CO., LTD., Anyang-Si, Gyeonggi-Do (KR)

( * ) Notice: Subject to any disclaimer, the term of this patent is extended or adjusted under 35 U.S.C. 154(b) by 282 days.

(21) Appl. No.: 13/636,764

(22) PCT Filed: Mar. 23, 2010

(86) PCT No.: PCT/KR2010/001781

§ 371 (c)(1),
(2), (4) Date: Oct. 5, 2012

(87) PCT Pub. No.: WO2011/118860

PCT Pub. Date: Sep. 29, 2011

(65) Prior Publication Data

US 2013/0020345 A1 Jan. 24, 2013

(51) Int. Cl.

| | |
|---|---|
| ***B65B 37/04*** | (2006.01) |
| ***B65B 37/16*** | (2006.01) |
| *A61J 7/02* | (2006.01) |
| *G07F 17/00* | (2006.01) |
| *B65B 57/20* | (2006.01) |

(52) U.S. Cl.

CPC ..... *B65B 37/04* (2013.01); *B65B 37/16* (2013.01); *A61J 7/02* (2013.01); *B65B 57/20* (2013.01); *G07F 17/0092* (2013.01)

(58) Field of Classification Search

CPC ..... B65B 37/04; B65B 37/16; B65B 57/20; A61J 7/02; G07F 17/0092

See application file for complete search history.

(56) References Cited

U.S. PATENT DOCUMENTS

| | | | | |
|---|---|---|---|---|
| 4,662,053 | A * | 5/1987 | Aceti et al. | 198/418.1 |
| 5,473,703 | A * | 12/1995 | Smith | 382/143 |
| 6,554,157 | B2 * | 4/2003 | Geltser et al. | 221/200 |
| 8,360,270 | B1 * | 1/2013 | McClosky et al. | 177/119 |
| 8,827,112 | B2 * | 9/2014 | Yuyama et al. | 221/237 |

FOREIGN PATENT DOCUMENTS

| | | |
|---|---|---|
| KR | 10-0817704 | 3/2008 |
| KR | 10-2008-0088548 | 10/2008 |
| KR | 10-2009-0031169 | 3/2009 |
| KR | 10-2009-0114188 | 11/2009 |

OTHER PUBLICATIONS

International Search Report issued in PCT Application No. PCT/KR2010/001781 dated Feb. 25, 2011.

* cited by examiner

*Primary Examiner* — Timothy Waggoner
(74) *Attorney, Agent, or Firm* — Ked & Associates, LLP

(57) ABSTRACT

An automatic free-form tablet dispenser in a medicine packing machine and a method for supplying a tablet are provided. The automatic free-form tablet dispenser in a medicine packing machine, which provides tablets input from the outside to a hopper of the medicine packing machine by a predetermined quantity, includes a main body having a guide track through which the tablet received inside the main body transfers, a driving unit making the tablet transfer along the guide track, an entrance detection sensor detecting whether the tablet is proceeding to the entrance of the guide track or not, an arrival detection sensor detecting whether the tablet reaches to the exit of the guide track or not, and a control unit determining whether the arrival detection sensor detects the tablet within a predetermined time after the entrance detection sensor has detected the tablet.

5 Claims, 7 Drawing Sheets

TABLET DISPENSER OF MEDICINE PACKING APPARATUS AND TABLET DISPENSING METHOD THEREOF

CROSS-REFERENCE TO RELATED PATENT APPLICATION

This application is a U.S. National Stage Application under 35 U.S.C. §371 of PCT Application No. PCT/KR2010/001781, filed Mar. 23, 2010.

TECHNICAL FIELD

Embodiments relates to a tablet dispenser of medicine packing machine and a method of dispensing a tablet, and more particularly, to a dispenser of automatically distributing free-form tablets in required quantities in an automatic medicine packing machine and a method of dispensing the tablets.

BACKGROUND ART

Generally, a medicine packing machine is an apparatus for packing medicine automatically when operating a medicine based on a prescription prescribed by a doctor or a pharmacist at the hospital or drugstore.

Conventional medicine packing machine is largely divided into a manual packing machine and an automatic packing machine.

The manual packing machine includes a distributing tray of round or square shaped which has a plurality of partitions containing tablets. An operator puts tablets in the partitions, and generally, a partition contains a single dosage of tablets. When the tablets are contained in the partitions, the tablets are transferred to a packing unit located in the lower portion of the machine for being packed and discharged outside.

The automatic packing machine includes a plurality of cassettes arranged in a drawer or drum type at the upper portion of the machine and each of the cassettes contains tablets. The tablets contained in the cassettes are discharged from the cassettes at a predetermined quantity based on input data of the interfaced computer. The discharged tablets are transferred to a hopper disposed at the lower portion of the machine and then packed in the packing unit disposed below the hopper.

The manual medicine packing machine and the automatic medicine packing machine have different methods of distributing tablets, but both of them pack medicine in a packing unit and discharge the same to the outside.

The manual medicine packing machine may be manufactured in a small-sized and usually used at the small drugstore or hospital, and the automatic medicine packing machine may be manufactured in a large-sized and usually used at the large drugstore or hospital handling large amount of medicine. Meanwhile, a mixed form of the manual medicine packing machine and the automatic medicine packing machine is also being used.

DETAILED DESCRIPTION OF THE INVENTION

Technical Goal of the Invention

It was impossible for the conventional automatic medicine packing machine to supply a piece tablet such as a half tablet or a specially formed tablet. An operator should input a tablet by using a manual medicine packing machine to supply such various shaped tablets. Accordingly, problems such as medicine compounding time being delayed and the compounding reliability being decreased due to tablet input exceeding or tablet input omitting have occurred.

The inventive concept provides an automatic free-form tablet dispenser in a medicine packing machine and a method for supplying a tablet, as a system for inputting tablets, transferring the input tablets and supplying the tablets each by a predetermined quantity, which may handle even free-form tablets.

The inventive concept also provides an automatic free-form tablet dispenser in a medicine packing machine and a method for supplying a tablet determining whether there is remaining tablets or not when it is once inserted and sensing an error generated during transferring a tablet.

The inventive concept also provides an automatic free-form tablet dispenser in a medicine packing machine and a method for supplying a tablet which may determine a tablet size comparatively accurately such that may increase tablet transferring performance and sort out broken tablets or damaged tablets.

Technical Solution of the Invention

According to an exemplary embodiment of the inventive concept, an automatic free-form tablet dispenser in a medicine packing machine, which provides tablets input from the outside into a hopper of the medicine packing machine each by a predetermined quantity, includes a main body, a driving unit, an entrance detection sensor, an arrival detection sensor, and a control unit. The main body includes a guide track through which a tablet received inside the main body is transferred. The driving unit makes the tablet transfer along the guide track. The entrance detection sensor detects whether the tablet is proceeding to the entrance side of the guide track or not. The arrival detection sensor detects whether the tablet reaches the exit side of the guide track or not. The control unit determines whether the arrival detection sensor detects the tablet within a predetermined time after the entrance detection sensor has detected the tablet.

A method for supplying a tablet of the automatic free-form tablet dispenser in a medicine packing machine includes the driving unit vibrating the main body so that a tablet received by the main body may be transferred to the upper portion along the guide track, detecting the tablet passing through the entrance of the guide track by the entrance detection sensor disposed by the entrance of the guide track, detecting the tablet passing through the exit of the guide track by the arrival detection sensor disposed by the exit of the guide track, and determining whether the arrival detection sensor detects the tablet within a predetermined time after the entrance detection sensor has detected the tablet.

According to another exemplary embodiment of the inventive concept, an automatic free-form tablet dispenser in a medicine packing machine includes a main body having a guide track through which a received tablet is transferred, a driving unit that makes the tablet transfer along the guide track, a first size measuring sensor disposed on the guide track for detecting the tablet passing through it, a second size measuring sensor disposed behind the first size measuring sensor at a certain distance for detecting the tablet passing through it, and an operating unit getting the tablet size by using a ratio of the time taken for the table passing through the first size measuring sensor to the time taken while the table transfers from the first size measuring sensor to the second size measuring sensor.

According to yet another exemplary embodiment of the inventive concept, a method for supplying a tablet of the automatic free-form tablet dispenser in a medicine packing machine having the above structure includes vibrating the main body so that a tablet may be transferred to the upper portion along the guide track by the driving unit, detecting the tablet by the first size measuring sensor, detecting the tablet by the second size measuring sensor, measuring the time taken for the tablet passing through the first size measuring sensor and the time taken while the table transfers from the first size measuring sensor to the second size measuring sensor, and getting the tablet size by operating a ratio of the time taken for the tablet passing through the first size measuring sensor to the time taken while the table transfers from the first size measuring sensor to the second size measuring sensor.

Effect of the Invention

An automatic free-form tablet dispenser in a medicine packing machine and a method for supplying a tablet according to an exemplary embodiment of the inventive concept may determine whether there are remaining tablets once they are received or not accurately such that may prevent tablets from being mixed and detect an error generated on a path of tablet transferring.

Also, the automatic free-form tablet dispenser in a medicine packing machine may determine the tablet size such that may increase transferring performance and sort out faulty tablets.

Accordingly, the automatic free-form tablet dispenser in a medicine packing machine may pack free-form tablets rapidly and accurately.

BRIEF DESCRIPTION OF THE DRAWINGS

Exemplary embodiments of the inventive concept will be more clearly understood from the following detailed description taken in conjunction with the accompanying drawings in which.

BEST MODE FOR CARRYING OUT THE INVENTION

Figure 1:
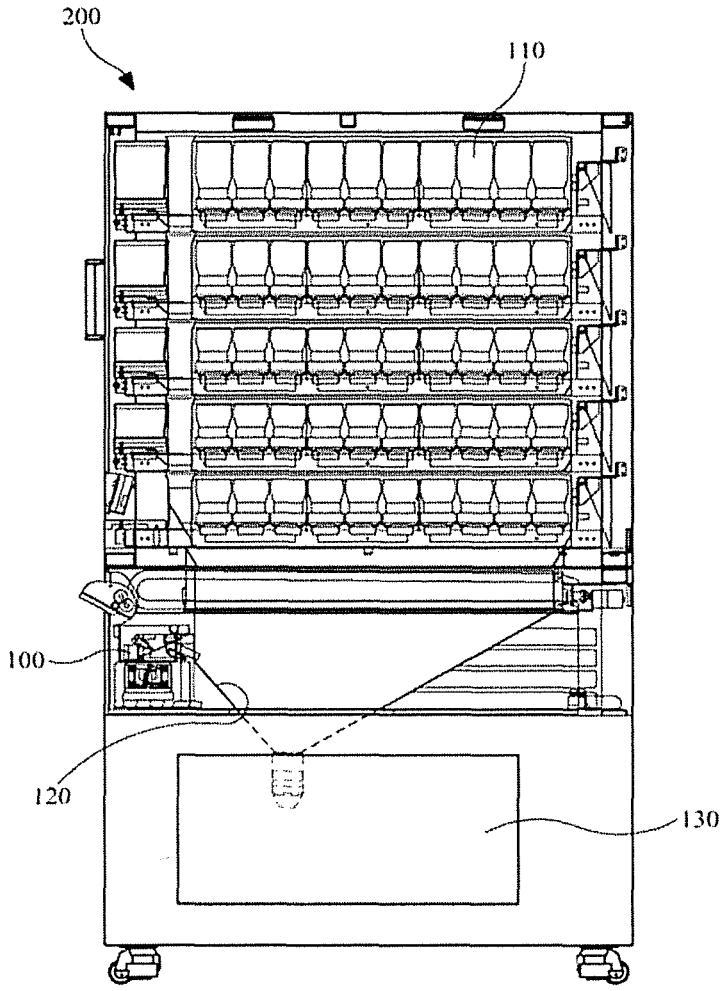
FIG. 1 is a schematic diagram of a medicine packing machine according to an exemplary embodiment of the inventive concept.

Various example embodiments will be described more fully hereinafter with reference to the accompanying drawings, in which some example embodiments are shown. Inventive concepts may, however, be embodied in many different forms and should not be construed as limited to the example embodiments set forth herein. Rather, example embodiments are provided so that this disclosure will be thorough and complete, and will fully convey the scope of inventive concepts to those skilled in the art. In the drawings, the sizes and relative sizes of layers and regions may be exaggerated for clarity. Like numerals refer to like elements throughout.

It will be understood that, although the terms first, second, third etc. may be used herein to describe various elements, these elements should not be limited by these terms. These terms are used to distinguish one element from another. Thus, a first element discussed below could be termed a second element without departing from the teachings of the inventive concepts. As used herein, the term "and/or" includes any and all combinations of one or more of the associated listed items.

It will be understood that when an element is referred to as being "connected" or "paired" to another element, it can be directly connected or paired to the other element or intervening elements may be present. In contrast, when an element is referred to as being "directly connected" or "directly paired" to another element, there are no intervening elements present. Other words used to describe the relationship between elements should be interpreted in a like fashion (e.g., "between" versus "directly between," "adjacent" versus "directly adjacent," etc.).

The terminology used herein is for the purpose of describing particular example embodiments only and is not intended to be limiting of the inventive concepts. As used herein, the singular forms "a," "an" and "the" are intended to include the plural forms as well, unless the context clearly indicates otherwise. It will be further understood that the terms "comprises," "comprising," "includes," and/or "including," when used in this specification, specify the presence of stated features, integers, steps, operations, elements, and/or components, but do not preclude the presence or addition of one or more other features, integers, steps, operations, elements, components, and/or groups thereof Unless otherwise defined, all terms (including technical and scientific terms) used herein have the same meaning as commonly understood by one of ordinary skill in the art to which inventive concepts belong. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

FIG. 1 is a side view illustrating a schematic structure of a medicine packing machine according to an exemplary embodiment of the inventive concept.

Referring to FIG. 1, the medicine packing machine 200 includes a cassette 110, a hopper 120, a packing unit 130, and an automatic free-form tablet dispenser 100. The cassette 110 contains a tablet therein, and a plurality of them are arranged in multiple stages. The hopper 120 is disposed below the cassette 110 in which the tablets are supplied by the cassette 110 and the automatic free-form tablet dispenser 100 are assembled. The packing unit 130 puts the tablets assembled in the hopper 120 into a packing paper by a single dosage, seals, cuts, and discharges the same outside. The automatic free-form tablet dispenser 100 provides the tablets received from outside to the hopper 120 of the medicine packing machine 200 each by a predetermined quantity.

Figure 2:
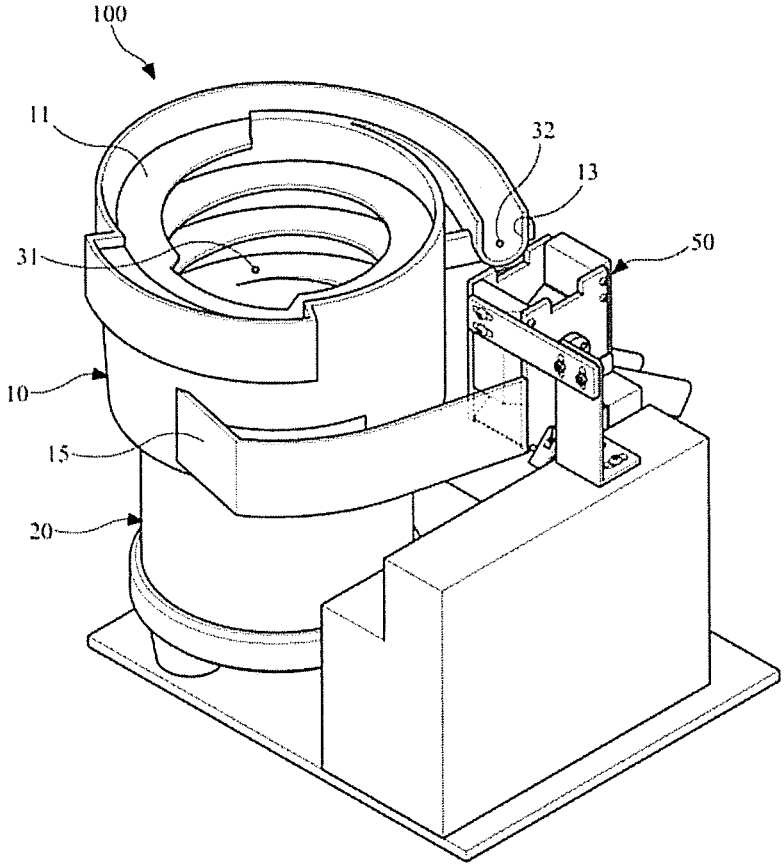
FIG. 2 is a perspective view of an automatic free-form tablet dispenser according to an exemplary embodiment of the inventive concept.
Figure 3:
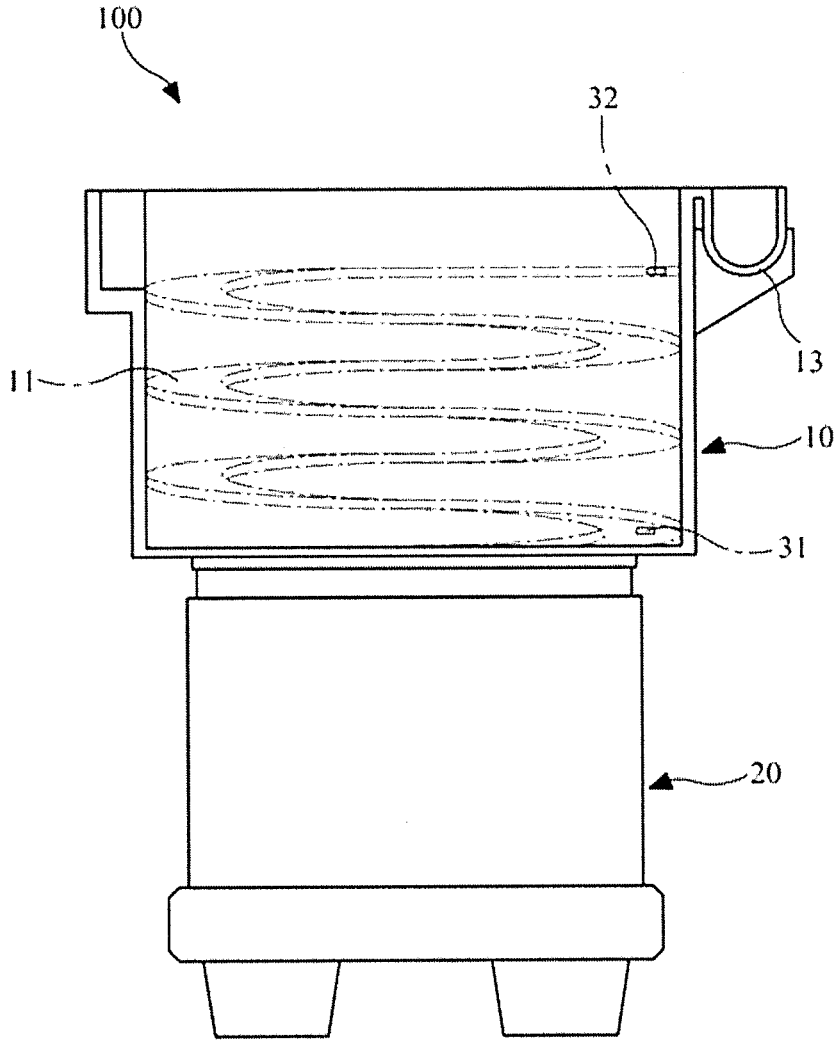
FIG. 3 is a side view of the automatic free-form tablet dispenser of FIG. 2.

FIG. 2 is a perspective view of an automatic free-form tablet dispenser, and FIG. 3 is a side view of the automatic free-form tablet dispenser.

Referring to FIGS. 2 and 3, the the automatic free-form tablet dispenser 100 includes a main body 10, a driving unit 20, an entrance detection sensor 31, an arrival detection sensor 32, and a control unit.

The main body 1, which includes a space unit in which a tablet input from the outside is received, includes a guide track 11. The guide track 11 is a path for the tablet received inside the main body 10 transferring through. Preferably, the main body 10 is a cylindrical shape whose upper portion is opened and the bottom is closed. Also, the guide track 11 is desired to form a spiral from the bottom to the upper portion of the main body 10.

The driving unit 20 makes the tablet received inside the main body 10 transfer along the guide track 11. The driving unit 20 may be embodied into a vibrator. That is, the driving unit 20 is installed at the lower portion of the main body 10 and vibrates the main body 10 minutely. At this time, the driving unit 20 rotates in a normal or counter direction. Like this, the tablets received inside the main body 10 transfers upward along the guide track 11 with vibration by the driving unit 20. Accordingly, an operator puts an entire bottle of tablets to the main body 10 and drives the driving unit 20 such that the tablets may be transferred along the guide track 11 one by one. The tablets transferred like the above are discharged to the exit of the guide track 11 and finally transferred to the hopper 120 of the medicine packing machine 200.

Meanwhile, the guide track 11 is desired to include a quantity control module 50 at its exit 13. The quantity control module 50 counts the number of tablets discharged to the exit 13 of the guide track 11 such that only a predetermined number of tablets may be discharged into the hopper 120. If the number of tablets discharged to the exit 13 of the guide track 11 is not equal to the predetermined number of tablets, the tablets may be recollected inside the main body 10 through a collection unit 15.

But, the structure of the main body 10 and the driving unit 20 is not restricted to the above descriptions and may be embodied into another form.

The entrance detection sensor 31 is desired to be disposed by the entrance of the guide track 11. That is, the entrance detection sensor 31 may be installed just before the entrance or just after the entrance. Also, the entrance detection sensor 31 may be installed at the edge of the lower portion of the main body 10. The entrance detection sensor 31 detects tablets approaching to the entrance of the guide track 11. The entrance detection sensor 31 may determine whether the tablets have enter the entrance of the guide track 11 according to whether the tablets by the entrance of the guide track 11 are detected or not.

A plurality of the entrance detection sensor 31 may be installed. The entrance detection sensor 31 may be composed of an emitting unit emitting light, a light catching unit catching light, and the like.

As described above, the tablets received inside the main body 10 are transferred to the upper portion of the main body 10 along the guide track 11 with vibration by the driving unit 20. At this time, the entrance detection sensor 31 performs a function of determining whether the tablets have entered the entrance of the guide track 11.

The arrival detection sensor 32 is desired to be disposed at the exit 13 of the guide track 11. The arrival detection sensor 32 may be installed on the guide track 11 or at the outside of the guide track 11. Or, the arrival detection sensor 32 may be installed at the position where the tablets drops from the exit of the guide track 11. The arrival detection sensor 32 detects the tablets have reached to the exit 13 of the guide track 11. The arrival detection sensor 32 may determine arrival of the tablets to the exit of the guide track 11 according to whether the tablets located at the exit of the guide track 11 are detected or not.

A number of the arrival detection sensor 32 may be installed. The arrival detection sensor 32 may be composed of an emitting unit emitting light, a light catching unit catching light, and the like.

As described above, the tablets received inside the main body 10 are transferred to the upper portion of the main body 10 along the guide track 11 with vibration by the driving unit 20. At this time, the arrival detection sensor 32 may perform a function of determining whether the tablets have reached the exit 13 of the guide track 11.

The control unit controls the arrival detection sensor 32 to detect the tablets within a predetermined time after the entrance detection sensor 31 has detected the tablets. The tablet received inside the main body 10 approaches to the entrance of the guide track 11 with vibration by the driving unit 20. That is, the vibration of the driving unit 20 makes the tablet move to the edge of the main body 10 by centrifugal force, proceed to the entrance of the guide track 11, and transfer to the upper portion along the guide track 11.

The time taken while the tablet transfers from the entrance to the exit of the guide track 11 is comparatively regular. For example, the time cost for the tablets transfer from the entrance to the exit of the guide track 11 may be 5 seconds, 10 seconds, 15 seconds, or the like. The time cost may be different according to the vibration speed of the driving unit 20, a length of the path of the guide track 11, and the size or shape of the tablet.

Not detecting the tablet by the entrance detection sensor 31 denotes that the tablets may not move toward the entrance of the guide track 11. Also, not detection the tablet by the arrival detection sensor 32 denotes that the tablets may not reach the exit 13 of the guide track 11. When the tablets are on normal transfer, the arrival detection sensor 32 may detect the tablet within a predetermined time period, such as 10 seconds, 15 seconds, or the like, after the entrance detection sensor 31 has detected the tablet.

When the arrival detection sensor 32 detects the tablet within a predetermined time after the entrance detection sensor 31 has detected the tablet, the tablet is determined to be normally transferred. When a final one tablet in the main body 10 is transferred normally, it is determined that there is no remaining tablet.

If the arrival detection sensor 32 fails to detect the tablet within a predetermined time after the entrance detection sensor 31 has detected the tablet, the tablet is determined to be in an error while transferring. The error may be the case that when the tablets drop out of the middle of the guide track 11, the tablets are stuck themselves to the guide track 11 and stop to proceed.

That is, when the arrival detection sensor 32 fails to detect the tablets while the entrance detection sensor 31 keeps on detecting the tablets, the tablets are determined to keep dropping out of the middle of the guide track 11 before the tablets reach the exit of the guide track 11. Also, when the arrival detection sensor 32 fails to detect the tablets after the entrance detection sensor 31 has detected the tablets, and there may not be additional detection of tablet by the entrance detection sensor 31, the tablets are determined to be stuck in the middle of the guide track 11 and stay therein.

Accordingly, the inventive concept may determine whether there are remaining tablets inside the main body 10 or not accurately. Thus, the inventive concept may prevent tablets from being mixed when supplementing tablets and may mark the number of the remaining tablets to the outside accurately.

Like the above, the automatic free-form tablet dispenser in a medicine packing machine 100 includes the entrance detection sensor 31 and the arrival detection sensor 32 and may prevent from the tablets being mixed themselves by determining whether there are remaining tablets or not once they are received in the main body 10. Also, it is possible to determine error occurrence in the process of tablet transferring so that rapid action may be taken.

Figure 4:
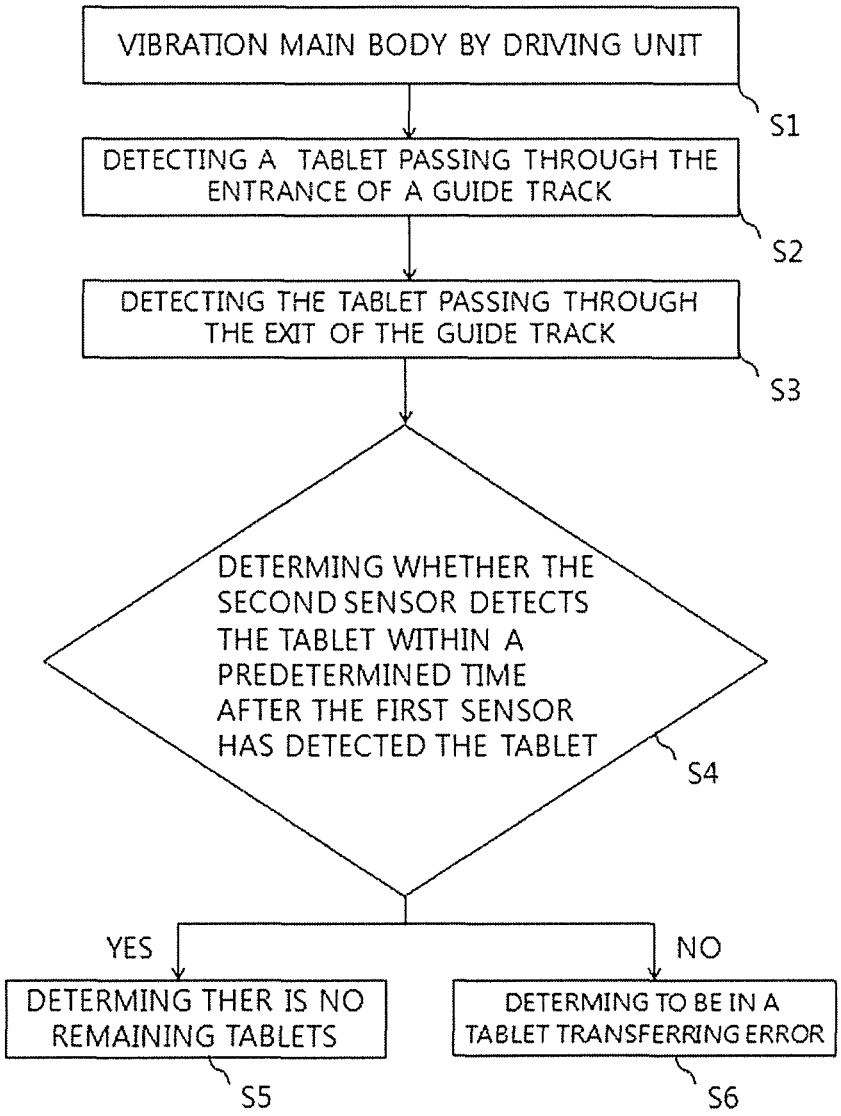
FIG. 4 is a flow chart illustrating a method for supplying a tablet according to an exemplary embodiment of the inventive concept.

FIG. 4 is a flow chart illustrating a method for supplying a tablet according to an exemplary embodiment of the inventive concept. Referring to FIG. 4, a method of the automatic free-form tablet dispenser having the above structure includes vibrating the main body S1, detecting whether the tablet has passed through the entrance of the guide track or not by the entrance detection sensor S2, detecting whether the tablet has passed through the exit of the guide track or not by the arrival detection sensor S3, and controlling the arrival detection sensor to detect the tablet within a predetermined time period after the entrance detection sensor has detected the tablet.

Referring to FIGS. 1 through 4, the vibrating the main body 10 (S1) is performed by the driving unit 20. The driving unit 20 vibrates the main body 10 such that the tablet received inside the main body 10 may be transferred to the upper portion. When the driving unit 20 begins to vibrate the main body 10, the tablet received inside the main body 10 transfers to the edge of the bottom of the main body 10 and then begins to proceed to the entrance of the guide track 11.

The detecting whether the tablet has passed through the entrance of the guide track 11 or not (S2) is performed by the entrance detection sensor 31. The entrance detection sensor 31 is disposed by the entrance of the guide track 11 and detects the tablet passing through it. A plurality of the entrance detection sensor 31 may be installed to increase reliability of the tablet detection.

The detecting whether the tablet has passed through the exit 13 of the guide track 11 (S3) is performed by the arrival detection sensor 32. The arrival detection sensor 32 is disposed by the exit 13 of the guide track 11 and detects the tablet passing through it. A plurality of the arrival detection sensor 32 may be installed to increase reliability of the tablet detection.

The controlling the arrival detection sensor 32 to detect the tablet within a predetermined time period after the entrance detection sensor 31 has detected the tablet (S4) is performed by the control unit. When the arrival detection sensor 32 detects the tablet within a predetermined time after the entrance detection sensor 31 has detected the tablet, it is determined that there are no remaining tablets in the main body 10 thanks to the normal transfer of the tablets (S5). Also, in case that the arrival detection sensor 32 fails to detect the tablet within a predetermined time period after the entrance detection sensor 31 has detected the tablet, it is desired to include determining to be in the tablet transfer error (S6). That is, in case that the arrival detection sensor 32 fails to detect the tablet within a predetermined time period after the entrance detection sensor 31 has detected the tablet, the tablet is determined to drop out of the guide track 11 while transferring or be stuck to the guide track 11, thereby stopping transferring.

If the arrival detection sensor 32 fails to detect the tablets while the entrance detection sensor 31 keeps on detecting the tablets, the tablets are determined to drop out of the middle of the guide track 11 repeatedly without completing tranferring to the exit of the guide track 11. Also, if the arrival detection sensor 32 fails to detect the tablet after the entrance detection sensor 31 has detected the tablet and there is no additional detection of the tablet by the entrance detection sensor 31, the tablet is determined to remain in the guide track 11 with being stuck or caught in the middle of the guide track 11.

When the transferring error of the tablet occurs like the above, it is desired to include transmitting a signal to a display device prepared at the outside of the machine.

Figure 5:
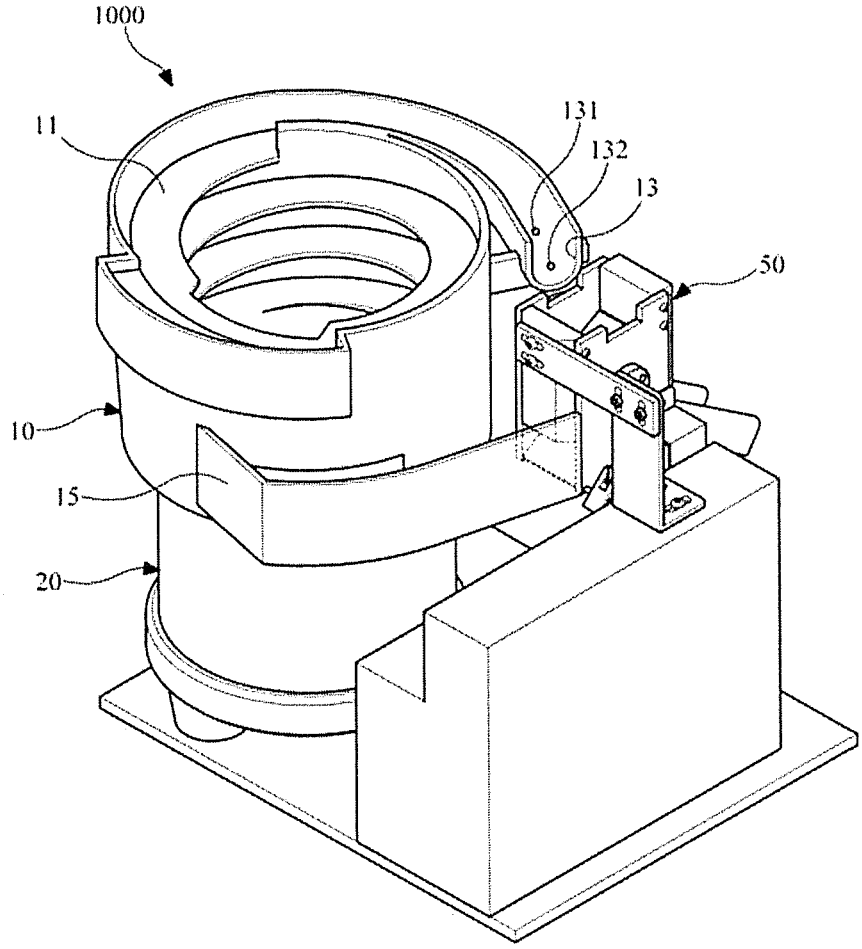
FIG. 5 is a perspective view of an automatic free-form tablet dispenser according to another exemplary embodiment of the inventive concept.

FIG. 5 is an automatic free-form tablet dispenser 1000 in the medicine packing machine according to another exemplary embodiment of the inventive concept. Referring to FIG. 5, the automatic free-form tablet dispenser 1000 in a medicine packing machine includes a main body 10, a driving unit 20, a first size measuring sensor 131, a second size measuring sensor 132, and an operating unit. At this time, the main body 10 and the driving unit 20 are identical to the main body 10 and the driving unit 20 in FIGS. 2 through 4 in function and structure, thus, the reference numbers are same, and the descriptions thereof are omitted herewith.

The first size measuring sensor 131 is installed on the guide track 11 and detects a tablet passing through it. The first size measuring sensor 131 is desired to be installed by the exit 13 of the guide track 11, even though the installation is not restricted thereto.

The first size measuring sensor 131 is embodied to detect the tablet going through it, which includes an emitting unit emitting light and a light catching unit catching the emitted light.

The second size measuring sensor 132 is installed on the guide track 11 behind the first size measuring sensor 131 at a certain distance. That is, the second size measuring sensor 132 is installed behind the first size measuring sensor 131 in the tablet progressing direction. The second size measuring sensor 132 also detects the tablet passing through it like the first size measuring sensor 131. The second size measuring sensor 132 is desired to be installed by the exit 13 of the guide track 11, even though the installation is not restricted thereto.

The second size measuring sensor 132 is embodied to detect the tablet going over itself, which includes an emitting unit emitting light and a light catching unit catching the emitted light.

The operating unit figures out the size of the tablet. The operating unit gets the size of the tablet by using a ratio of time taken for the table to pass through the first size measuring sensor 131 to time taken while the tablet transfers from the first size measuring sensor 131 to the second size measuring sensor 132. The time taken for the table to pass through the first size measuring sensor 131 is proportional to the size of the tablet. That is, as the tablet size is larger, the time taken for the tablet to pass through the first size measuring sensor 131 increases, and as the tablet size is smaller, the time take for the tablet to pass through the first size measuring sensor 131 decreases.

The time taken while the tablet transfers from the first size measuring sensor 131 to the second size measuring sensor 132 is consistent regardless the tablet size.

The operating unit uses the below relation expression to figure out the exact tablet size.

$$D=S\times T2\div T1,$$

wherein D is the tablet size, T1 is the time taken for the tablet to pass through the first size measuring sensor 131, and T2 is the time taken while the tablet transfers from the first size measuring sensor 131 to the second size measuring sensor 132. Also, S is the distance from the first size measuring sensor 131 to the second size measuring sensor 132.

Figure 6:
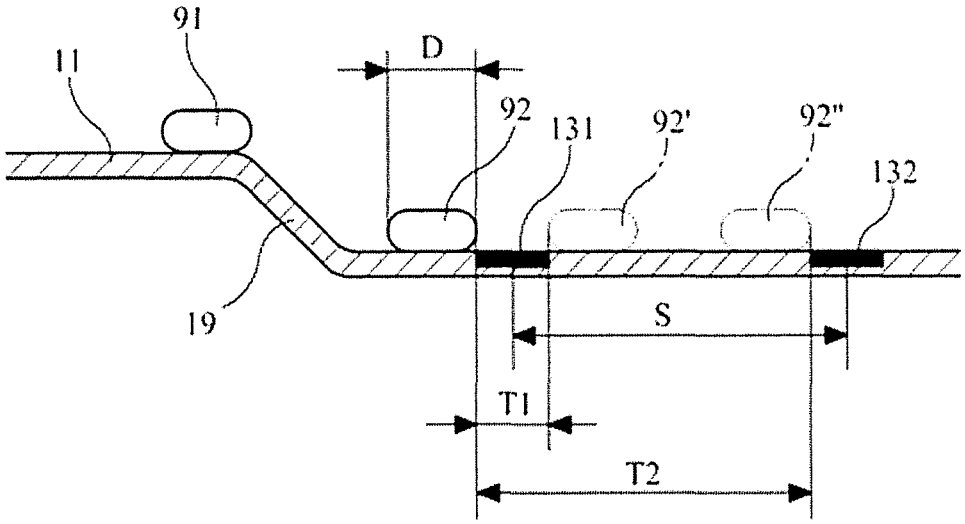
FIG. 6 is a cross sectional view of a guide track of the automatic free-form tablet dispenser of FIG. 5.

FIG. 6 is a cross sectional view of the guide track. Referring to FIG. 6, the time T1 for the tablet 92 to pass through the first size measuring sensor 131 is the time cost for transferring from the position of tablet 92 to the position of tablet 92' of FIG. 6. That is, the time T1 taken for the tablet 92 to pass through the first size measuring sensor 131 may be obtained by the time difference between the time at the moment of the tablet 92 entering the first size measuring sensor 131 and the time at the moment of the tablet 92' going through the first size measuring sensor.

Also, the time T2 taken while the tablet transfers from the first size measuring sensor 131 to the second size measuring sensor 132 is the time taken while the tablet 92 located just before the first size measuring sensor 131 transfers to the location of the tablet 92" just before the second size measuring sensor 132. That is, the time T2 taken while the tablet transfers from the first size measuring sensor 131 to the second size measuring sensor 132 may be obtained by the time difference between the time at the moment of the tablet 92 entering the first size measuring sensor 32 and the time at the moment of the tablet 92" entering the second size measuring sensor 32. Or, the time T2 taken while the tablet transfers from the first size measuring sensor 131 to the second size measuring sensor 132 may be obtained by the time difference between the time at the moment of the tablet going through the first size measuring sensor 131 and the time at the moment of the tablet going through the second size measuring sensor 132.

The distance S from the first size measuring sensor 131 and to the second size measuring sensor 132 is a constant number which has no variation.

Meanwhile, the speed V1 while the tablet 92 transfers from the first size measuring sensor 131 to the second size measuring sensor 132 may be obtained as followings;

$$V1=S\div T2,$$

wherein the speed V1 while the tablet 92 transfers from the first size measuring sensor 131 to the second size measuring sensor 132 may be obtained by dividing the distance S between the first size measuring sensor 131 and the second size measuring sensor 132 by the time T2 taken while the tablet transfers from the first size measuring sensor 131 to the second size measuring sensor 132.

The speed V2 at the moment when the tablet 92 passing through the first size measuring sensor 131 may be obtained as followings;

$$V2=D\div T1,$$

wherein, the speed V2 at the moment when the tablet 92 passing through the first size measuring sensor 131 may be obtained by dividing the tablet size by the time T1 taken for the tablet 92 passing through the first size measuring sensor 131.

At this time, the speed V1 while the tablet 92 transfers from the first size measuring sensor 131 to the second size measuring sensor 132 is quite similar to the speed V2 at the moment when the tablet 92 passing through the first size measuring sensor 131.

Thus, if it is assumed to be V1=V2, the following expression may be obtained;

$$D=S\times T2\div T1.$$

Meanwhile, the automatic free-form tablet dispenser 1000 may further include a control unit.

The control unit controls a vibration speed of the driving unit 20. That is, the control unit reduces the tablet transferring speed when the size of the tablet is larger than a predetermined reference and increases the tablet transferring speed when the size of the tablet is smaller than the predetermined reference.

Also, the guide track 11 is desired to include a slope 19.

The slope 19 is formed at the front of the first size measuring sensor 131. The tablet passing through the slope 19 has acceleration by the free falling principle. Thus, the two tablets 91 and 92 having transferred closely together become separated at regular interval while passing through the slope 19. Accordingly, it is possible to get much more accurate size of the tablet.

Figure 7:
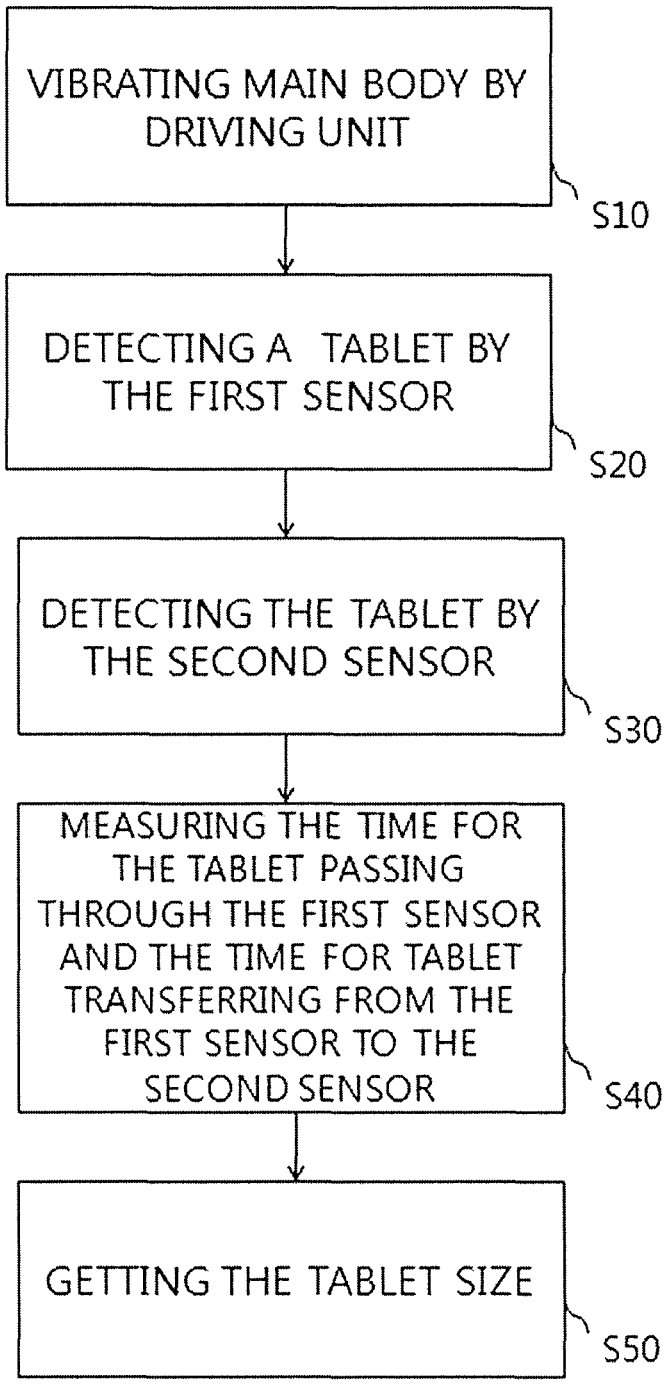
FIG. 7 is a flow chart illustrating a method for supplying a tablet according to yet another exemplary embodiment of the inventive concept.

FIG. 7 is a flow chart illustrating a method for supplying a tablet according to another exemplary embodiment of the inventive concept, which may be applied to the automatic free-form tablet dispenser shown in FIGS. 5 and 6. Referring to FIG. 7, the method for supplying a tablet in the automatic free-form tablet dispenser includes vibrating the main body by the driving unit (S10), detecting the tablet by the first size measuring sensor (S20), detecting the tablet by the second size measuring sensor (S30), measuring the time taken for the tablet to pass through the first size measuring sensor and the time taken while the tablet transfers from the first size measuring sensor to the second size measuring sensor (S40), and figuring out the size of the tablet (S50).

Referring to FIGS. 5 and 7, the vibrating the main body 10 by the driving unit 20 (S10) moves the tablet to the upper portion along the guide track 11.

The detecting the tablet by the first size measuring sensor 131 (S20) is performed by the first size measuring sensor 131 disposed on the guide track 11.

The detecting the tablet by the second size measuring sensor 131 (S30) is performed by the second size measuring sensor 132 disposed on the guide track 11. The second size measuring sensor 132 is disposed at a certain distance S from the first size measuring sensor 131.

Thereafter, measuring the time T1 for the tablet to pass through the first size measuring sensor 131 and the time T2 taken while the table transfers from the first size measuring sensor 131 to the second size measuring sensor 132 is performed. T1 may be obtained by the difference between the time when the tablet entering the first size measuring sensor 131 and the time when the tablet going through the first size measuring sensor 131. T2 may be obtained by the difference the time when the tablet entering the first size measuring sensor 131 and the time when the tablet entering the second size measuring sensor 132 (S40).

The figuring out the tablet size D (S50) may be performed by operating a ratio of the time TI for the tablet passing through the first size measuring sensor 131 to the time T2 taken while the tablet transfers from the first size measuring sensor 131 to the second size measuring sensor 132.

The operating unit uses the following relation expression to get more accurate size of the tablet;

$$D=S\times T2\div T1,$$

wherein the time T1 taken for the tablet 92 to pass through the first size measuring sensor 131 is the time cost from the position of the tablet 92 to the position of the tablet 92'. That is, the time T1 may be obtained by the difference between the time at the moment of the tablet 92 entering the first size measuring sensor 131 and the time at the moment of the tablet 92' going through the first size measuring sensor 131.

Also, the time T2 taken while the tablet transfers from the first size measuring sensor 131 to the second size measuring sensor 132 is the time cost from the position of the tablet 92 to the position of the tablet 92". That is, the time T2 may be obtained by the difference between the time at the moment of the tablet 92 entering the first size measuring sensor 131 and the time at the moment of the tablet 92" entering the second size measuring sensor 132. Also, the time T2 may be obtained by the difference between the time at the moment of the tablet going through the first size measuring sensor 131 and the time at the moment of the tablet going through the second size measuring sensor 132.

Also, the distance S from the first size measuring sensor 131 to the second size measuring sensor 132 is a constant number which has no variation.

Meanwhile, the speed V1 while the tablet 92 transfers from the first size measuring sensor 131 to the second size measuring sensor 132 may be obtained with the following expression;

$$V1=S\div T2,$$

wherein the speed V1 is obtained by dividing the distance S from the first size measuring sensor 131 to the second size measuring sensor 132 by the time T2 taken while the tablet transfers from the first size measuring sensor 131 to the second size measuring sensor 132.

The speed V2 at the moment of the tablet 92 passing through the first size measuring sensor 131 may be obtained by the following expression;

$$V2=D\div T1,$$

wherein the speed V2 is obtained by dividing the tablet size by the time T1 taken for the tablet 92 passing through the first size measuring sensor 131.

At this time, the speed V1 while the tablet 92 transfers from the first size measuring sensor 131 to the second size measuring sensor 132 is quite similar to the speed V2 at the moment of the tablet 92 passing through the first size measuring sensor 131.

Thus, if it is assumed to be V1=V2, the following expression may be obtained;

$$D=S\times T2\div T1.$$

Meanwhile, the method for supplying a tablet in the automatic free-form tablet dispenser may further include controlling the driving unit 20.

The controlling driving unit reduces the tablet transferring speed when the tablet size is larger than a predetermined reference and increases the tablet transferring speed when the tablet size is smaller than the predetermined reference. Accordingly, the tablet transferring may be more effective.

Also, the method for supplying a tablet in the automatic free-form tablet dispenser is desired to include passing through a slope.

Referring to FIG. 6, the guide track 11 may include the slope 19 which is formed at the front of the first size measuring sensor 131. That is, the slope 19 is disposed at the front of the first size measuring sensor 131 toward the entrance direction of the guide track 11. The tablet passing through the slope 19 has acceleration by the free falling principle. Thus, the two tablets 91 and 92 having been transferred closely together become separated at regular interval while passing through the slope 19. Accordingly, it is possible to get much more accurate size of the tablet.

While the present invention has been particularly shown and described with reference to exemplary embodiments thereof, it will be understood that various changes in form and details may be made therein without departing from the spirit and scope of the following claims.

What is claimed is:

1. An automatic free-form tablet dispenser in a medicine packing machine, which provides tablets input from the outside to a hopper of the medicine packing machine by a predetermined quantity, comprising:

a main body having a guide track through which the received tablets are transferred;

a driving unit making the tablet transfer along the guide track;

an entrance detection sensor detecting whether the tablet is proceeding to the entrance of the guide track or not;

an arrival detection sensor detecting whether the tablet reaches the exit of the guide track or not; and a control unit determining whether the arrival detection sensor detects the tablet within a predetermined time period after the entrance detection sensor has detected the tablet and determining dropping the tablet out of the guide track when the arrival detection sensor fails to detect the tablet while the entrance detection sensor keeps on detecting tablets.

2. The automatic free-form tablet dispenser of claim 1, wherein the control unit determines to be in a transfer error, when the arrival detection sensor fails to detect the tablet within a predetermined time period after the entrance detection sensor has detected the tablet.

3. The automatic free-form tablet dispenser of claim 1, wherein the guide track forms a spiral form from the bottom to the upper portion of the main body.

4. A method for supplying a tablet in the automatic free-form tablet dispenser of a medicine packing machine comprises;

vibrating the main body by the driving unit such that the tablet received inside the main body transfer to the upper portion along the guide track;

detecting the tablet passing through the entrance of the guide track by the entrance detection sensor disposed by the entrance of the guide track;

detecting the tablet passing through the exit of the guide track by the arrival detection sensor disposed by the exit of the guide track;

determining whether the arrival detection sensor detects the tablet within a predetermined time period after the entrance detection sensor has detected the tablet; and determining that the tablet drops out of the guide track when the arrival detection sensor fails to detect the tablet while the entrance detection sensor has detected the tablet repeatedly.

5. The method of claim 4 further comprises determining to be in a transfer error, when the arrival detection sensor fails to detect the tablet after the entrance detection unit has detected the tablet.

* * * * *